US011971224B2

(12) United States Patent
Yin et al.

(10) Patent No.: US 11,971,224 B2
(45) Date of Patent: Apr. 30, 2024

(54) PLATE-FIN HEAT EXCHANGER

(71) Applicant: Zhejiang Sanhua Automotive Components Co., Ltd., Hangzhou (CN)

(72) Inventors: Fangfang Yin, Zhejiang (CN); Jiguang Zou, Zhejiang (CN); Jiang Zou, Zhejiang (CN); Weixin Jiang, Zhejiang (CN)

(73) Assignee: Zhejiang Sanhua Automotive Components Co., Ltd., Hangzhou (CN)

( * ) Notice: Subject to any disclaimer, the term of this patent is extended or adjusted under 35 U.S.C. 154(b) by 504 days.

(21) Appl. No.: 17/255,386

(22) PCT Filed: Apr. 10, 2019

(86) PCT No.: PCT/CN2019/082038
§ 371 (c)(1),
(2) Date: Dec. 22, 2020

(87) PCT Pub. No.: WO2020/001125
PCT Pub. Date: Jan. 2, 2020

(65) Prior Publication Data

US 2021/0262735 A1 Aug. 26, 2021

(30) Foreign Application Priority Data

Jun. 29, 2018 (CN) ..... 201810702894.7

(51) Int. Cl.
*F28D 9/00* (2006.01)
*F28F 3/04* (2006.01)
(Continued)

(52) U.S. Cl.
CPC ..... *F28D 9/0037* (2013.01); *F28F 3/044* (2013.01); *F28F 3/046* (2013.01); *F28F 3/06* (2013.01); *F28F 3/086* (2013.01); *F28F 2275/06* (2013.01)

(58) Field of Classification Search
CPC ..... F28D 9/0056; F28D 9/0037; F28D 9/005; F01N 1/082
See application file for complete search history.

(56) References Cited

U.S. PATENT DOCUMENTS 4,002,201 A 1/1977 Donald
5,884,696 A * 3/1999 Loup ..... F28D 1/0333 165/42
(Continued)

FOREIGN PATENT DOCUMENTS

CA 2485036 A1 * 4/2006 ..... F28D 9/005
CN 100417906 C 9/2008
(Continued)

OTHER PUBLICATIONS

Translation of EP0742418A2 entitled Translation-EP0742418A2 (Year: 2023).*
(Continued)

*Primary Examiner* — Paul Alvare
(74) *Attorney, Agent, or Firm* — Wolf, Greenfield & Sacks, P.C.

(57) ABSTRACT

A plate-fin heat exchanger, including first plates and second plates, several protrusions being provided on the side of a first plate surface of each first plate, a fin being provided between a second plate surface of each first plate and a first plate surface of the adjacent second plate, and no fin being provided between the side of the first plate where the protrusions are provided and the second plate surface of the adjacent second plate. The heat exchanger increases flow turbulence in first fluid channels by using the fins, and increases flow turbulence in second fluid channels by using a structure of the several protrusions, so that low-pressure fluid can flow through the first fluid channels, and high-pressure fluid can flow through the second fluid channels.

8 Claims, 5 Drawing Sheets

(51) Int. Cl.
*F28F 3/06* (2006.01)
*F28F 3/08* (2006.01)

(56) References Cited

U.S. PATENT DOCUMENTS

| | | | | |
|---|---|---|---|---|
| 5,931,219 | A | 8/1999 | Kull et al. | |
| 9,316,448 | B2 * | 4/2016 | Kanzaka | F28D 9/005 |
| 2002/0026999 | A1 * | 3/2002 | Wu | F28D 9/005 165/167 |
| 2003/0201094 | A1 | 10/2003 | Evans et al. | |
| 2006/0081358 | A1 * | 4/2006 | Pierre | F28F 9/026 165/81 |
| 2006/0144051 | A1 | 7/2006 | Mehendale et al. | |
| 2008/0066893 | A1 | 3/2008 | Oh et al. | |
| 2010/0258285 | A1 * | 10/2010 | Yao | F28F 3/046 165/167 |
| 2013/0087317 | A1 | 4/2013 | Papoulis et al. | |
| 2013/0228307 | A1 | 9/2013 | Kanzaka et al. | |
| 2015/0000869 | A1 * | 1/2015 | Denoual | F28D 9/0056 165/96 |
| 2015/0233650 | A1 * | 8/2015 | Blomgren | F28F 13/06 165/166 |
| 2016/0356205 | A1 * | 12/2016 | Braun | F02M 35/10268 |
| 2017/0184347 | A1 | 6/2017 | Ariyama et al. | |
| 2019/0017748 | A1 | 1/2019 | Sun et al. | |
| 2019/0219313 | A1 * | 7/2019 | Draenkow | F28F 3/027 |

FOREIGN PATENT DOCUMENTS

| | | | | |
|---|---|---|---|---|
| CN | 100510600 | C | 7/2009 | |
| CN | 103210275 | A | 7/2013 | |
| CN | 106802099 | A | 6/2017 | |
| DE | 0742418 | A2 * | 11/1996 | |
| FR | 2867845 | A1 * | 9/2005 | F28D 1/0341 |
| JP | H08-35788 | A | 2/1996 | |
| JP | 2742834 | B2 * | 4/1998 | |
| JP | 2002164071 | A * | 6/2002 | F28D 9/0043 |
| JP | 2013-076523 | A | 4/2013 | |
| JP | 5788284 | B2 | 9/2015 | |
| KR | 19990084296 | A * | 12/1999 | |
| KR | 2011-0031814 | A | 3/2011 | |
| KR | 20110031814 | A * | 3/2011 | |
| KR | 1020140083227 | A * | 12/2012 | |
| KR | 20180050917 | A * | 5/2018 | |
| WO | WO 03/093749 | A1 | 11/2003 | |
| WO | WO-2009054162 | A1 * | 4/2009 | F28D 9/0037 |
| WO | WO-2014065742 | A1 * | 5/2014 | F28D 9/00 |
| WO | WO-2015075672 | A1 * | 5/2015 | F24H 1/38 |
| WO | WO 2017/138322 | A1 | 8/2017 | |
| WO | WO 2018/036467 | A1 | 3/2018 | |
| WO | WO-2018036467 | A1 * | 3/2018 | F28D 9/00 |

OTHER PUBLICATIONS

Translation of KR20140083227A entitled Translation-KR20140083227A (Year: 2023).*

PCT/CN2019/082038, Jun. 11, 2019, International Search Report and Written Opinion.

Extended European Search Report for European Application No. 19824896.5, dated Mar. 1, 2022.

International Search Report and Written Opinion for International Application No. PCT/CN2019/082038, dated Jun. 11, 2019.

* cited by examiner

PLATE-FIN HEAT EXCHANGER

This application is a national stage filing under 35 U.S.C. § 371 of International Patent Application Serial No. PCT/CN2019/082038, filed Apr. 10, 2019, which claims priority to Chinese Patent Application No. 201810702894.7, titled "HEAT EXCHANGER", filed with the China National Intellectual Property Administration on Jun. 29, 2018. The contents of these applications are incorporated herein by reference in their entireties.

FIELD

The present application relates to the technical field of heat exchange, and in particular to a heat exchanger.

BACKGROUND

The plate-fin type heat exchanger is generally composed of plates and fins. A fluid passage is formed after the fin is placed between two adjacent plates. Multiple plates are stacked in different ways according to the actual needs, and are brazed into a whole to form a plate bundle. The plate-fin type heat exchanger is formed by assembling the plate bundle with corresponding sealing plugs, connecting pipes, support members and other parts.

Compared with the conventional heat exchanger, the plate-fin type heat exchanger has a secondary surface and a very compact structure. The turbulence of the fins to fluid causes the boundary layer of fluid to break continuously. Moreover, due to the high thermal conductivity of the plates and the fins, the plate-fin type heat exchanger has high efficiency.

The fins can improve the flow turbulence of fluid, but also have the disadvantages of high flow resistance and low pressure resistance. Therefore, the plate-fin type heat exchanger is hardly suitable for heat exchange between low-pressure fluid and high-pressure fluid.

SUMMARY

In order to solve the above technical problem, a heat exchanger is provided according to the present application, which includes a heat exchange core. The heat exchange core includes multiple first plates, multiple second plates and fins. The first plate includes a first plate surface, multiple protrusions protruding from the first plate surface, and a second plate surface opposite to the first plate surface. The second plate includes a first plate surface and a second plate surface opposite to the first plate surface. A first fluid passage and a second fluid passage isolated from each other are formed in the heat exchange core. The fin is arranged between the second plate surface of the first plate and the first plate surface of the second plate, and the protrusions are located between the first plate surface of the first plate and the second plate surface of the adjacent second plate. A first passage is formed between the second plate surface of the first plate and the first plate surface of the second plate, and the first passage is part of the first fluid passage. A second passage is formed between the first plate surface of the first plate and the second plate surface of the second plate, and the second passage is part of the second fluid passage.

The provided heat exchanger includes the first plate and the second plate, multiple protrusions are provided on the first plate surface of the first plate, the fin is provided between the second plate surface of the first plate and the first plate surface of the adjacent second plate, and turbulent flow between a side of the first plate provided with the protrusions and the second plate surface of the adjacent second plate is realized by the multiple protrusions. The heat exchanger improves the flow turbulence in the first fluid passage by the fins, and improves the flow turbulence in the second fluid passage by the multiple protrusion structures, so that low-pressure fluid can flow through the first fluid passage, and high-pressure fluid can flow through the second fluid passage.

DETAILED DESCRIPTION OF THE EMBODIMENTS

Specific embodiments of the present application will be illustrated hereinafter in conjunction with accompanying drawings.

Figure 1:
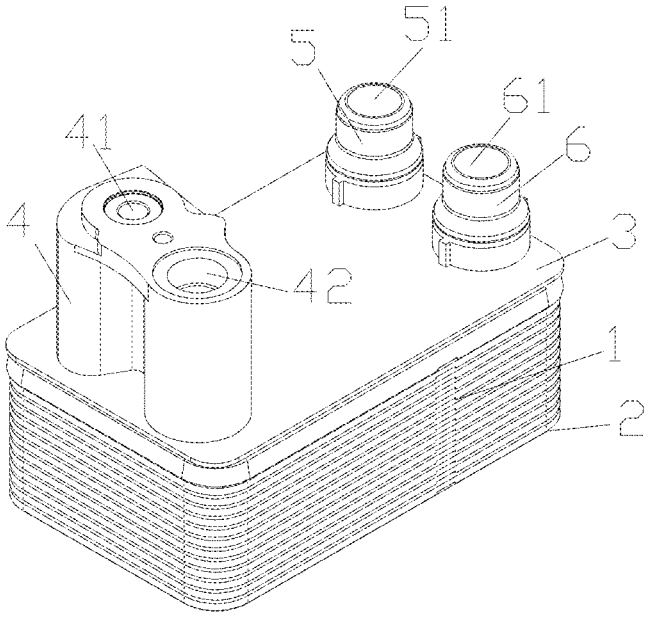
FIG. 1 is a schematic perspective view of an embodiment of a heat exchanger according to the present application.
Figure 2:
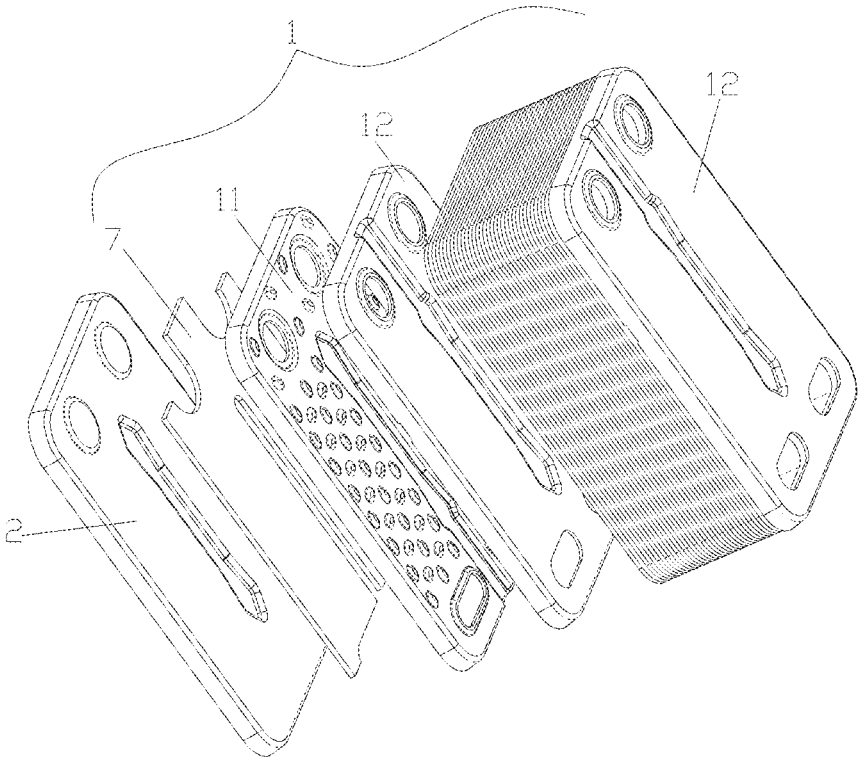
FIG. 2 is a schematic exploded view of a bottom plate and part of a heat exchange core of the heat exchanger shown in FIG. 1.

FIG. 1 is a schematic perspective view of an embodiment of a heat exchanger according to the present application. FIG. 2 is a schematic exploded view of a bottom plate and part of a heat exchange core of the heat exchanger shown in FIG. 1. As shown in the figures, in the present embodiment, the heat exchanger includes a top plate 3, a heat exchange core 1 and a bottom plate 2, and the heat exchange core includes multiple first plates 11, multiple second plates 12 and multiple fins 7. In the present embodiment, one of the first plates 11 closer to the bottom plate 2 than any one of the second plates 12, and one fin 7 is arranged between the bottom plate 2 and the first plate 11. This fin 7 is also part of the heat exchange core 1, and one of the second plates 12 is adjacent to the top plate 3.

Multiple first plates 11 and multiple second plates 12 which are stacked in sequence are assembled with each other to form the heat exchange core 1, and the heat exchange core 1 is provided with a first fluid passage and a second fluid passage isolated from each other. The heat exchanger further includes a first connecting pipe 5 and a second connecting pipe 6. The first connecting pipe 5 includes a first connecting port passage 51, and the second connecting pipe 6 includes a second connecting port passage 61. The first connecting port passage 51 and the second connecting port passage 61 are in communication with the first fluid passage, and the first connecting port passage 51 is in communication with the second connecting port passage 61 through the first fluid passage.

The heat exchanger further includes an adapter 4 which includes a third connecting port passage 41 and a fourth connecting port passage 42. The third connecting port passage 41 and the fourth connecting port passage 42 are in communication with the second fluid passage, and the third connecting port passage 41 is in communication with the fourth connecting port passage 42 through the second fluid passage. It should be noted herein that the adapter 4 may include two portions similar to the first connecting pipe 5 and the second connecting pipe 6. The structure of the adapter in the present embodiment is conducive to the installation of an external connection pipeline. Two external connection pipes respectively in communication with the third connecting port passage 41 and the fourth connecting port passage 42 may be fixedly installed by a pressing block, which is convenient for installation and saves materials.

Figure 3:
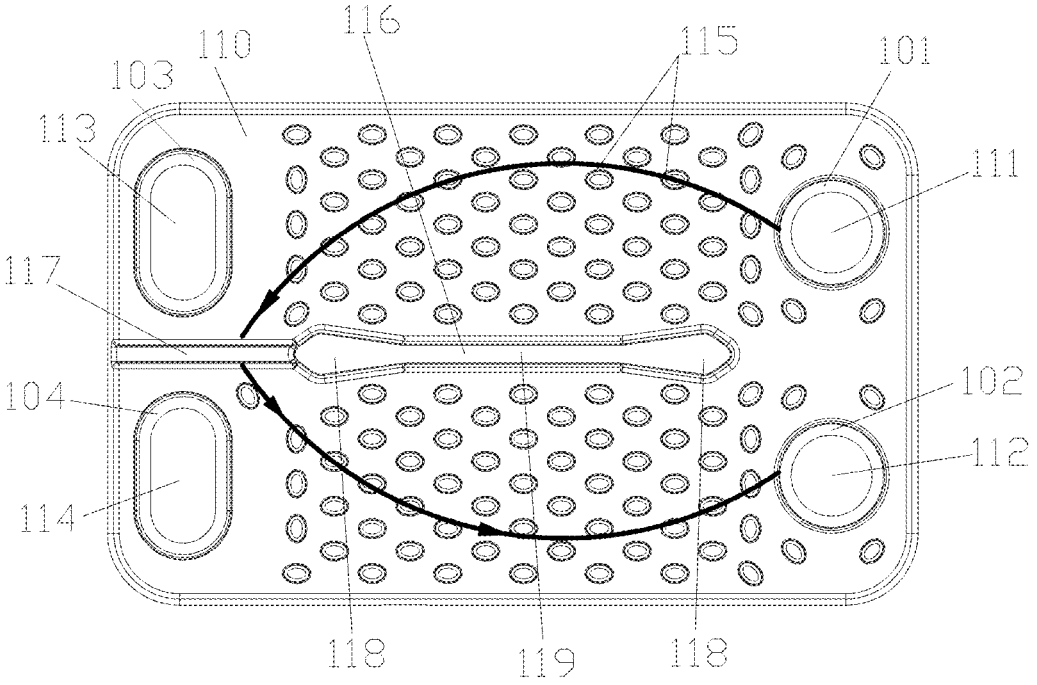
FIG. 3 is a schematic structural view of a first plate of the heat exchanger shown in FIG. 2.

As shown in FIGS. 2 and 3, the first plate 11 includes a first plate surface 110, a first corner hole portion 101 and a second corner hole portion 102 recessed into the first plate surface 110, a third corner hole portion 103 and a fourth corner hole portion 104 protruding from the first plate surface 110, multiple protrusions 115 protruding from the first plate surface 110, and a first recess 116 and a second recess 117 recessed into the first plate surface 110.

The first corner hole portion 101 is provided with a first corner hole 111, the second corner hole portion 102 is provided with a second corner hole 112, the third corner hole portion 103 is provided with a third corner hole 113, and the fourth corner hole portion 104 is provided with a fourth corner hole 114. The first corner hole 111 and the second corner hole 112 are round holes, the first corner hole 111 is in communication with the fourth connecting port passage 42, and the second corner hole 112 is in communication with the third connecting port passage 41. The third corner hole 113 and the fourth corner hole 114 are oblong holes, the third corner hole 113 is in communication with the second connecting port passage 61, and the fourth corner hole 114 is in communication with the first connecting port passage 51. It should be noted here that the third corner hole 113 and the fourth corner hole 114 may be in other shapes such as a circle.

The protrusions 115 are distributed in a region where the first plate surface 110 is located. In the present embodiment, most of the protrusions 115 are distributed between the first corner hole portion 101 and the third corner hole portion 103, and between the second corner hole portion 102 and the fourth corner hole portion 104. In order to improve the heat exchange performance of the heat exchanger, the protrusions 115 are also arranged between the first corner hole portion 101 and the second corner hole portion 102. This part of protrusions 115 can function to guide the fluid, thereby improving the heat transfer coefficient of the region between the first corner hole portion 101 and the second corner hole portion 102. Similarly, corner portions of the first plate 11 adjacent to the first corner hole portion 101 and the second corner hole portion 102 may also be provided with the protrusions 115, and this part of protrusions 115 can also function to guide the fluid, thereby improving the heat transfer coefficient of these corner portion regions.

The first recess 116 is connected with the second recess 117. The second recess 117 is arranged between the third corner hole portion 103 and the fourth corner hole portion 104. The first recess 116 is arranged in the distribution region of the protrusions 115, and most of the protrusions 115 are distributed on two sides of the first recess 116. In the present embodiment, the protrusions 115 are evenly distributed on the two sides of the first recess 116, and at least part of the protrusions 115 are symmetrically distributed on the two sides of the first recess 116. Such an arrangement can improve the flow turbulence of the fluid and further cause the fluid to be evenly distributed, thereby improving the heat exchange performance of the heat exchanger.

The first recess 116 has a dumbbell-shaped structure with two end portions thereof wider than the middle portion thereof (one of the two end portions faces toward the third corner hole 113 and the fourth corner hole 114, and the other of the two end portions faces the first corner hole portion 101 and the second corner hole portion 102). The first recess 116 can function to guide the fluid, and this structure is also conducive to the even distribution of fluid and has low flow resistance, which can improve the heat exchange performance.

In the present embodiment, the two end portions of the first recess 116 are wider than the second recess 117. In this arrangement, the heat exchange area of a portion between the first corner hole 111 and the second corner hole 112 is large, which is conducive to improving the heat exchange performance of the heat exchanger.

It should be noted here that a recessed structure (not shown in the figure) corresponding to the protruding structure and a protruding structure (not shown in the figure) corresponding to the recessed structure are provided on a second plate surface (not shown in the figure) side opposite to the first plate surface 110 of the first plate 11.

Figure 4:
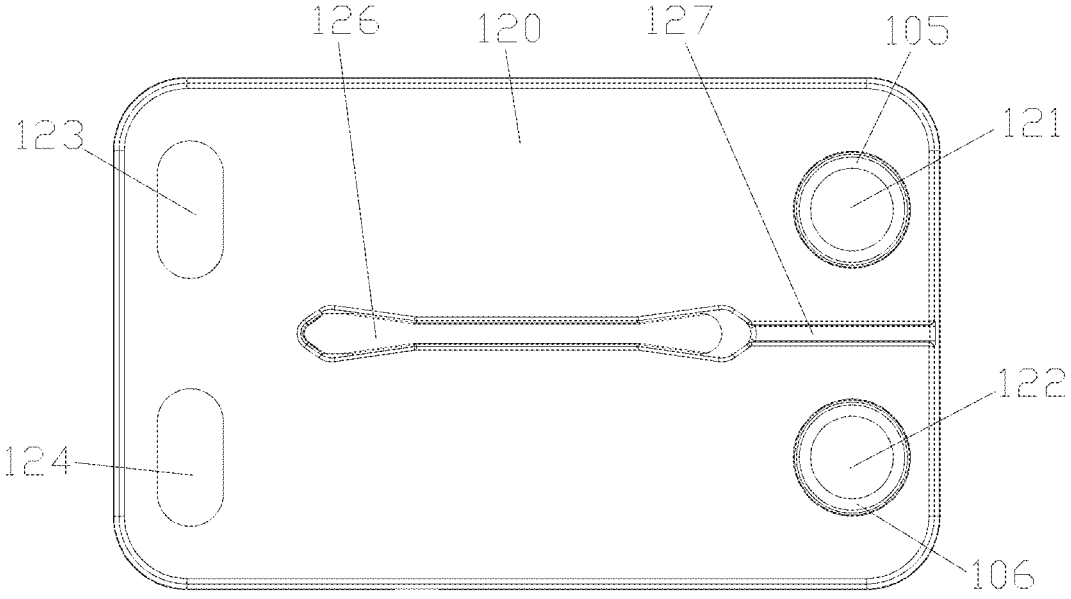
FIG. 4 is a schematic structural view of a second plate of the heat exchanger shown in FIG. 2.
Figure 5:
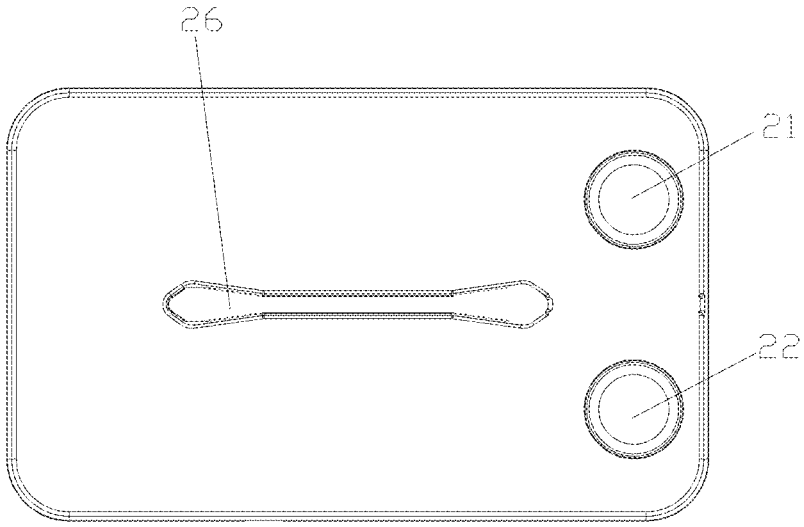
FIG. 5 is a schematic structural view of the bottom plate of the heat exchanger shown in FIG. 2.

As shown in FIGS. 2 and 4, the second plate 12 includes a first plate surface 120, a first corner hole portion 105 and a second corner hole portion 106 protruding from the first plate surface 120, and a first recess 126 and a second recess 127 recessed into the first plate surface 110.

The first corner hole portion 105 is provided with a first corner hole 121, the second corner hole portion 106 is provided with a second corner hole 122, and the second plate 12 is further provided with a third corner hole 123 and a fourth corner hole 124. The first corner hole 121 and the second corner hole 122 are round holes, the first corner hole 121 is in communication with the fourth connecting port passage 42, and the second corner hole 122 is in communication with the third connecting port passage 41. The third corner hole 123 and the fourth corner hole 124 are oblong holes, the third corner hole 123 is in communication with the second connecting port passage 61, and the fourth corner hole 124 is in communication with the first connecting port passage 51. It should be noted here that the third corner hole 123 and the fourth corner hole 124 may be in other shapes such as a circle.

The first recess 126 is connected with the second recess 127, and the second recess 127 is arranged between the third corner hole portion 105 and the fourth corner hole portion 106. The first recess 126 has a dumbbell-shaped structure with two end portions thereof wider than the middle portion thereof. The first recess 126 can function to guide the fluid, which is conducive to the even distribution of fluid and has low flow resistance and can improve the heat exchange performance.

In the present embodiment, the two end portions of the first recess 126 are wider than the second recess 127. In this arrangement, the heat exchange area of a portion between the first corner hole 121 and the second corner hole 122 is large, which is conducive to improving the heat exchange performance of the heat exchanger.

It should be noted here that a recessed structure (not shown in the figure) corresponding to the protruding structure and a protruding structure (not shown in the figure) corresponding to the recessed structure are provided on a second plate surface (not shown in the figure) side opposite to the first plate surface 120 of the second plate 12.

Figure 6:
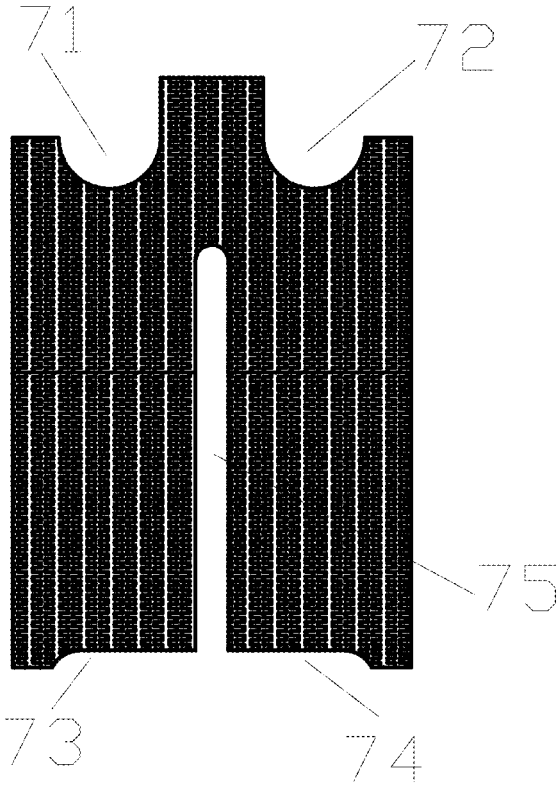
FIG. 6 is a schematic structural view of a fin of the heat exchanger shown in FIG. 2.
Figure 7:
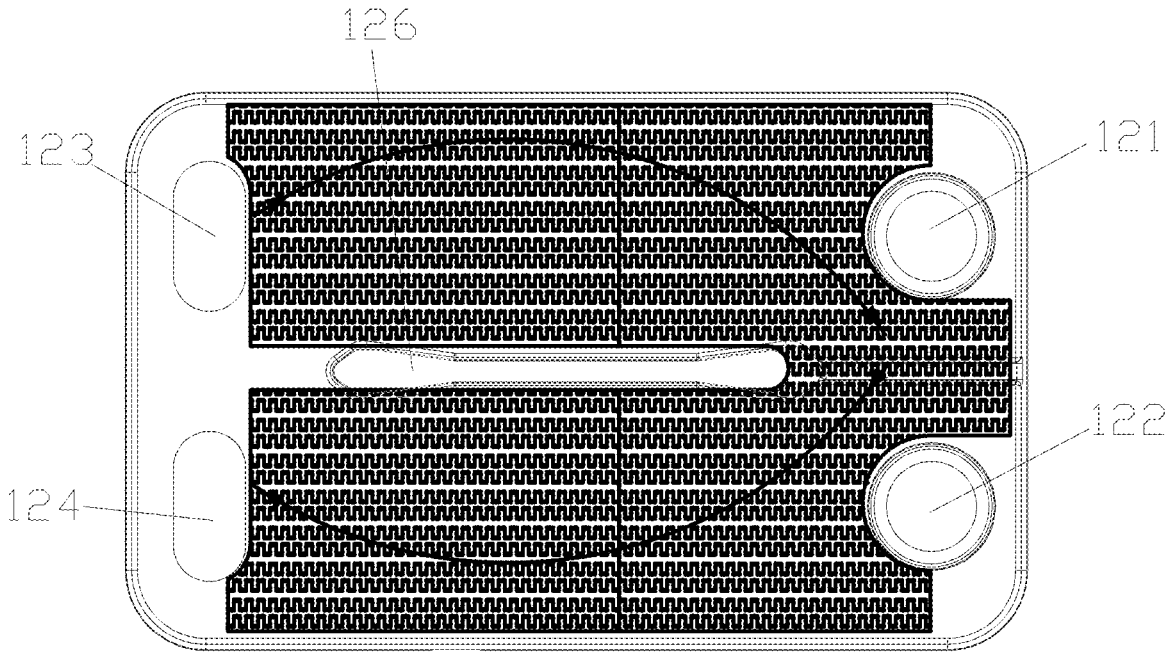
FIG. 7 is a schematic structural view of a combination of the second plate and the fin shown in FIG. 2.

As shown in FIGS. 6 and 7, the fin 7 is arranged on the first plate surface 120 of the second plate 12. The fin 7 includes a first port region 71 corresponding to the first corner hole portion 105, a second port region 72 corresponding to the second corner hole portion 106, a third port region 73 corresponding to the third corner hole 123, a fourth port region 74 corresponding to the fourth corner hole 124, and a notch region 75 corresponding to the first recess 126. Part of the fin 7 is located between the first corner hole portion 105 and the second corner hole portion 106, which, on the one hand, can function to guide the fluid, and on the other hand, improve the flow turbulence of the coolant in this region. In this way, in the refrigerant inlet and outlet region, the coolant and refrigerant can fully conduct heat exchange, thereby improving the heat exchange performance. However, no fin is provided between the third corner hole 123 and the fourth corner hole 124. That is because less refrigerant exists in the region close to the third corner hole 123 and the fourth corner hole 124, and this arrangement can enable the amount of coolant and the amount of refrigerant to match, which is conducive to improving the heat exchange performance.

Figure 8:
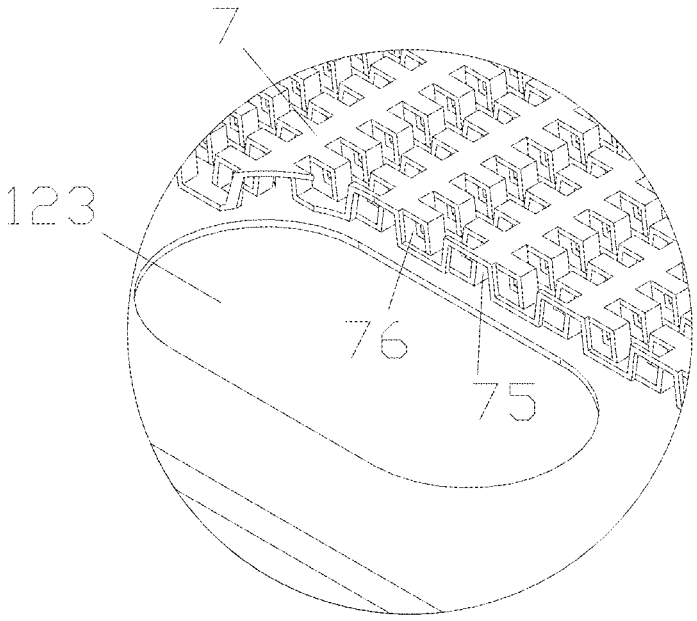
FIG. 8 is a schematic partially perspective view of the combination of the second plate and the fin shown in FIG. 7.

As shown in FIG. 8, in the present embodiment, the fin 7 is a window fin, and a center line of a window 76 of the window fin 7 and a center line of a flow passage 75 of the window fin 7 are parallel to a width direction of the third corner hole 123, which is conducive to reducing the flow resistance of the coolant, thereby improving the heat exchange performance. Here, the width direction of the third corner hole 123 refers to the width direction of the oblong hole. In a case that the third corner hole 123 has other structures, the width direction thereof is still the same as that of the oblong hole.

As shown in FIGS. 2 to 9, the first plate surface 110 of the first plate 11 is opposite to the second plate surface of the second plate 12; the protrusions 115, the third corner hole portion 13 and the fourth corner hole portion 14 of the first plate 11 are in contact with and fixed to the second plate surface of the second plate 12 by welding; the protruding structure corresponding to the second recess 127 of the second plate 12 is in contact with and fixed to the first plate surface 110 of the first plate 11 by welding; and the protruding structure corresponding to the first recess 126 of the second plate 12 is in contact with and fixed to the first recess 116 of the first plate 11 by welding, so that part of the second fluid passage is formed between the first plate surface 110 of the first plate 11 and the second plate surface of the second plate 12. In addition, the first recess 116 of the first plate 11 may be deeper than the second recess 117 of the first plate 11, and the first recess 126 of the second plate 12 may be deeper than the second recess 127 of the second plate 12. This structure is easy to process and install, and the area of the first plate surface 110 is large, which is conducive to improving the heat exchange performance.

Since the protruding structures corresponding to the first recess 126 and the second recess 127 of the second plate 12 function to obstruct, the refrigerant flowing in from the first corner hole 111 flows out of the second corner hole 112 after successively passing through a region where the protrusions 115 on one side of the first recess 116 of the first plate 11 are located, a region where the second recess 117 of the first plate 11 is located, and a region where the protrusions 115 on the other side of the first recess 116 of the first plate 11 are located.

The second plate surface of the first plate 11 is opposite to the first plate surface 120 of the second plate 12, the fin 7 is arranged between the second plate surface of the first plate 11 and the first plate surface 120 of the second plate 12. The first corner hole portion 105 and the second corner hole portion 106 of the second plate 12 are in contact with and fixed to the protruding structures corresponding to the first corner hole portion 101 and the second corner hole portion 102 of the first plate 11 by welding. The protruding structure corresponding to the second recess 117 on the second plate surface side of the first plate 11 is in contact with and fixed to the first plate surface 120 of the second plate 12 by welding. The protruding structure corresponding to the first recess 116 of the first plate 11 is in contact with and fixed to the first recess 126 of the second plate 12 by welding. In this way, part of the first fluid passage is formed between the first plate surface 120 of the second plate 12 and the second plate surface of the first plate 11.

Since the protruding structures corresponding to the first recess 116 and the second recess 117 of the first plate 11 function to obstruct, the coolant flowing in from the third corner hole 123 flows out of the fourth corner hole 123 after successively passing through a fin region on a side of the first recess 126 of the second plate 12, a region where the second recess 127 of the second plate 12 is located, and a fin region on other side of the first recess 126 of the second plate 12. By arranging the fin, the flow turbulence of the coolant can be improved, and the performance of the heat exchanger is improved.

In the present embodiment, a passage formed between the second plate surface of the first plate 11 and the first plate surface 120 of the second plate 12 is the first passage (not shown in the figure), and a passage formed between the first plate surface 110 of the first plate 11 and the second plate surface of the second plate 12 is the second passage (not shown in the figure). The number of the first passages is one more than that of the second passages, which causes the refrigerant to fully absorb heat, thereby ensuring the degree of superheat.

Figure 9:
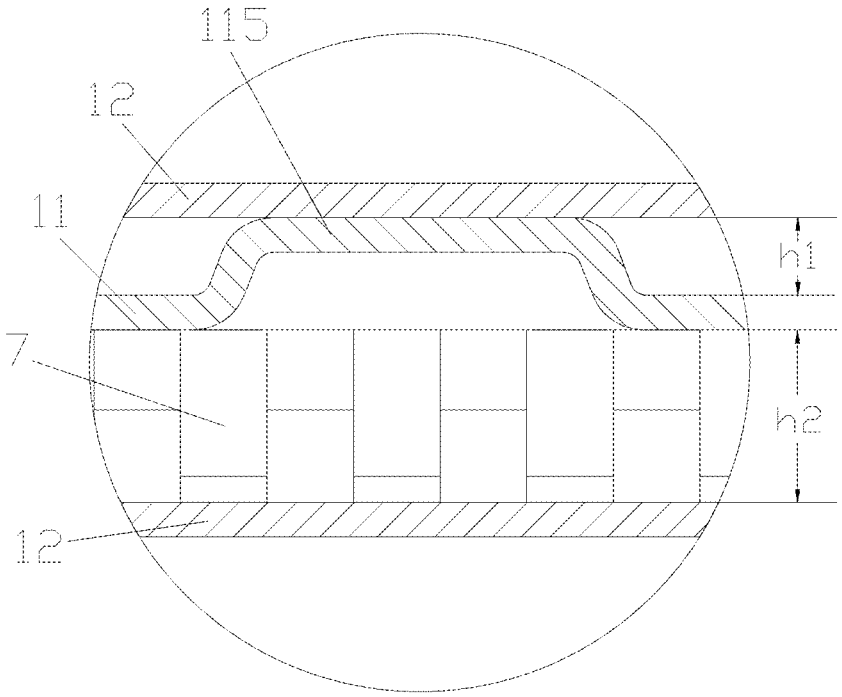
FIG. 9 is a schematic partially sectional view of the heat exchange core of the heat exchanger shown in FIG. 1.

As shown in FIG. 9, a distance (that is, the height of the fin 7) between the second plate surface of the first plate 11 and the first plate surface 120 of the second plate 12 is defined as h2, and the distance (that is, the height of the protrusion 15) between the first plate surface 110 of the first plate 11 and the second plate surface of the second plate 12 is defined as h1. h2 and h1 preferably meet the requirements of $1<h2/h1<4$. According to experiments or simulation, such an arrangement can further improve the heat transfer coefficient.

The embodiments described hereinabove are only specific embodiments of the present application, and are not intended to limit the scope of the present application in any form. Preferred embodiments of the present application are disclosed above, and are not intended to limit the present application. Many variations and modifications may be made to the technical solution of the present application, or equivalent embodiments may be modified from the technical solution of the present application by those skilled in the art based on the methods and the technical contents disclosed above without departing from the scope of the present application. Therefore, any alternations, equivalents and modifications made to the embodiments above according to the technical essential of the present application without departing from the content of the technical solution of the present application should fall within the scope of protection of the present application.

The invention claimed is:

1. A plate-fin heat exchanger, comprising a heat exchange core, the heat exchange core comprising a plurality of first plates, a plurality of second plates and fins, wherein the first plate comprises a first plate surface, a plurality of protrusions protruding from the first plate surface, and a second plate surface opposite to the first plate surface, the second plate comprises a first plate surface and a second plate surface opposite to the first plate surface, a first fluid passage and a second fluid passage isolated from each other are formed in the heat exchange core, the fin is arranged between the second plate surface of the first plate and the first plate surface of the second plate, and the protrusions are located between the first plate surface of the first plate and the second plate surface of another second plate, a first passage is formed between the second plate surface of the first plate and the first plate surface of the second plate, the first passage is part of the first fluid passage, a second passage is formed between the first plate surface of the first plate and the second plate surface of the second plate, and the second passage is part of the second fluid passage, the first plate further comprises a first corner hole portion and a second corner hole portion recessed into the first plate surface, and a first recess and a second recess recessed into the first plate surface, wherein the first recess of the first plate is connected with the second recess, part of the protrusions are arranged in a region between the first corner hole portion and the second corner hole portion of the first plate, another part of the protrusions are arranged at a corner portion adjacent to the first corner hole portion and a corner portion adjacent to the second corner hole portion of the first plate, two end portions of the first recess of the first plate are wider than a middle portion of the first recess, and the two end portions of the first recess of the first plate are wider than the second recess, wherein a height of the fin is greater than a height of the protrusion, and a ratio of the height of the fin to the height of the protrusion is greater than 1 and less than 4, the first plate further comprises a third corner hole portion and a fourth corner hole portion protruding from the first plate surface, protruding structures corresponding to the first recess and the second recess of the first plate are provided on a second plate surface side of the first plate, the second recess is arranged between the third corner hole portion and the fourth corner hole portion, and a portion of the protrusions are distributed on two sides of the first recess, the second plate further comprises a first corner hole portion and a second corner hole portion protruding from the first plate surface, and a first recess and a second recess recessed into the first plate surface, protruding structures corresponding to the first recess and the second recess of the second plate are provided on a second plate surface side of the second plate, the first recess is connected with the second recess, and the second recess is arranged between the first corner hole portion and the second corner hole portion of the second plate, the second plate is further provided with a third corner hole and a fourth corner hole, the fin comprises a first port region corresponding to the first corner hole portion, a second port region corresponding to the second corner hole portion, a third port region corresponding to the third corner hole, a fourth port region corresponding to the fourth corner hole, and a notch region corresponding to the first recess, and part of the fin is located between the first corner hole portion and the second corner hole portion.

2. The plate-fin heat exchanger according to claim 1, wherein two end portions of the first recess of the second plate are wider than a middle portion of the first recess, and the two end portions of the first recess of the second plate are wider than the second recess.

3. The plate-fin heat exchanger according to claim 1, wherein, the fin is a window fin, and a center line of a window of the window fin and a center line of a flow passage of the window fin are parallel to a width direction of the third corner hole.

4. The plate-fin heat exchanger according to claim 1, wherein the protrusions, the third corner hole portion and the fourth corner hole portion of the first plate are in contact with and fixed to the second plate surface of the adjacent second plate by welding, a protruding structure corresponding to the second recess of the second plate is in contact with and fixed to the first plate surface of the adjacent first plate by welding, a protruding structure corresponding to the first recess of the second plate is in contact with and fixed to the first recess of the adjacent first plate by welding, the first recess of the first plate is deeper than the second recess of the first plate, and the first recess of the second plate is deeper than the second recess of the second plate.

5. The plate-fin heat exchanger according to claim 1, wherein the heat exchanger further comprises a top plate and a bottom plate located on two sides of the heat exchange core, the bottom plate is adjacent to one of the first plates, one fin is arranged between the bottom plate and the adjacent first plate, and the top plate is adjacent to one of the second plates, and the number of the first passages is one more than the number of the second passages.

6. The plate-fin heat exchanger according to claim 5, wherein two end portions of the first recess of the second plate are wider than a middle portion of the first recess, and the two end portions of the first recess of the second plate are wider than the second recess.

7. The plate-fin heat exchanger according to claim 5, wherein the fin is a window fin, and a center line of a window of the window fin and a center line of a flow passage of the window fin are parallel to a width direction of the third corner hole.

8. The plate-fin heat exchanger according to claim 5, wherein the protrusions, the third corner hole portion and the fourth corner hole portion of the first plate are in contact with and fixed to the second plate surface of the adjacent second plate by welding, a protruding structure corresponding to the second recess of the second plate is in contact with and fixed to the first plate surface of the adjacent first plate by welding, a protruding structure corresponding to the first recess of the second plate is in contact with and fixed to the first recess of the adjacent first plate by welding, the first recess of the first plate is deeper than the second recess of the first plate, and the first recess of the second plate is deeper than the second recess of the second plate.

* * * * *